US007117927B2

(12) United States Patent
Kent et al.

(10) Patent No.: US 7,117,927 B2
(45) Date of Patent: Oct. 10, 2006

(54) SNAP-ON MOUNTING BRACKET FOR HEAT EXCHANGERS

(75) Inventors: Scott Edward Kent, Albion, NY (US); David A. Southwick, Lockport, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/940,837

(22) Filed: Sep. 14, 2004

(65) Prior Publication Data

US 2006/0054306 A1 Mar. 16, 2006

(51) Int. Cl.
*F28F 9/007* (2006.01)

(52) U.S. Cl. ..... 165/67; 24/458; 180/68.4; 248/231.81

(58) Field of Classification Search ..... 165/67, 165/149; 180/68.4; 24/458; 248/229.21, 248/229.26, 228.7, 231.81, 221.11, 222.11, 248/222.12, 250
See application file for complete search history.

(56) References Cited

U.S. PATENT DOCUMENTS

| | | | | | |
|---|---|---|---|---|---|
| 2,654,131 | A | * | 10/1953 | Poupitch | 24/458 |
| 2,662,323 | A | * | 12/1953 | Cheney | 248/222.11 |
| 3,276,806 | A | * | 10/1966 | Hansen | 24/458 |
| 3,314,177 | A | * | 4/1967 | Mies, Jr. et al. | 24/458 |
| 4,047,353 | A | * | 9/1977 | Aarons | 248/228.7 |
| 4,484,621 | A | * | 11/1984 | Kuchelmeister | 165/67 |
| 4,856,746 | A | * | 8/1989 | Wrobel et al. | 248/250 |
| 4,896,926 | A | * | 1/1990 | Verholt | 24/458 |
| 5,069,275 | A | | 12/1991 | Suzuki et al. | |
| 5,205,349 | A | | 4/1993 | Nagao et al. | 165/67 |
| 5,240,068 | A | | 8/1993 | Tokutake | |
| 5,535,819 | A | | 7/1996 | Matsuura | 165/149 |
| 5,570,737 | A | | 11/1996 | Tokutake | 165/67 |
| 5,685,364 | A | * | 11/1997 | Harris | 165/67 |
| 5,697,431 | A | | 12/1997 | Nagasaka | 165/149 |
| 5,791,402 | A | * | 8/1998 | Dumetz | 165/67 |
| 6,315,034 | B1 | * | 11/2001 | Mahe et al. | 165/67 |
| 6,481,682 | B1 | * | 11/2002 | Miura | 24/458 |
| 6,510,891 | B1 | | 1/2003 | Anderson et al. | 165/67 |
| 6,513,579 | B1 | | 2/2003 | Kent et al. | 165/67 |
| 6,691,767 | B1 | | 2/2004 | Southwick | 165/67 |
| 6,901,992 | B1 | * | 6/2005 | Kent et al. | 165/67 |
| 2002/0194710 | A1 | * | 12/2002 | Dickinson et al. | 24/295 |

FOREIGN PATENT DOCUMENTS

| | | | |
|---|---|---|---|
| JP | 04288488 | A * | 10/1992 |
| JP | 06185505 | A * | 7/1994 |
| JP | 09280769 | A * | 10/1997 |
| JP | 2000039286 | A * | 2/2000 |

* cited by examiner

*Primary Examiner*—Leonard R. Leo
(74) *Attorney, Agent, or Firm*—Patrick M. Griffin

(57) ABSTRACT

A mounting system for a heat exchanger assembly consisting of a plastic bracket secured to the heat exchanger after brazing and requires no additional fasteners. The bracket includes a pair of arms that extend over a reinforcement member and engage a core. The first arm presents a resilient finger extending in a cantilever fashion to a protrusion presenting a ramp. The ramp allows the finger to flex outward as the bracket is assembled over the reinforcement member until the ramp snaps over and engages an edge on the reinforcement member. A notch and hole on the reinforcement member align with a male post and a second section of the bracket to limit movement of the bracket relative to the heat exchanger assembly. The arms have aligned openings, to create an airway through the bracket.

24 Claims, 4 Drawing Sheets

SNAP-ON MOUNTING BRACKET FOR HEAT EXCHANGERS

BACKGROUND OF THE INVENTION

1. Field of the Invention

This invention relates to heat exchanger attachments in general, and specifically to a novel design for an automotive heat exchanger mounting bracket.

2. Description of the Related Art

Automotive heat exchangers generally include a central core made of regularly spaced tubes and intermediate corrugated air fins. The tubes extend between a pair of header tanks at opposite ends of the core. A pair of reinforcement members extend along sides of the core between the tanks. The heat exchanger is usually mounted to a vehicle or other heat exchangers by bracket(s) extending from the header tanks or from the reinforcement members to a vehicle structure, where the bracket accepts a fastener. Most of the brackets are metal pieces that are somehow held in place before the brazing operation and then are brazed into a fixed attachment. Such is disclosed in U.S. Pat. No. 5,570,737 where the bracket clamps on to the header tank prior to the furnace brazing of the heat exchanger assembly.

The addition of the bracket during the furnace brazing introduces irregularities to the braze temperature profile. In addition, such brackets are limited to locations on the pre-brazed heat exchanger that are able to receive and retain the bracket until after the brazing joins the components.

Separate brackets may be attached to the unit after the brazing operation, as disclosed in U.S. Pat. No. 5,535,819, where the brackets are bolted by fasteners to the core assembly by one or more fasteners for each of the four brackets. Using fasteners requires considerable labor and additional equipment.

To avoid such labor a plastic bracket may be snapped onto the heat exchanger, as disclosed in U.S. Pat. No. 6,513,579. These plastic brackets are light molded pieces that are attached to the corners entirely post braze, in a simple press fit operation that requires no additional fasteners. An additional plastic bracket as seen in U.S. Pat. No. 6,691,767, utilizes a molded plastic bracket designed to engage the extruded rail on the header tank. The extruded rail is machined with additional features, such as three holes, to allow the bracket to snap onto the rail.

There is always utility for a simple and unique bracket that can accommodate the brazing and processing of the heat exchanger, requires no additional fasteners or machining, and allows flexibility to locate the bracket along the length of the heat exchanger for better integration with the demands of the complex vehicle structures and the varying location of mating components.

BRIEF SUMMARY OF THE INVENTION AND ADVANTAGES

The subject invention provides a unique mounting system for a heat exchanger assembly comprising a core having a first end and a second end defining a length and sides defining a width and opposite faces defining a thickness. At least one reinforcement member, having an edge, extends along a side thereof between the first and second ends. A bracket, having a pair of first and second arms, extends around the reinforcement member and engages the faces of the core for supporting the heat exchanger assembly on a vehicle. The first arm of the bracket includes a resilient finger and a protrusion extending inward toward the second arm. The protrusion presents a ramp to allow the resilient finger to move over the reinforcement member as the resilient finger flexes outward from the arms until the ramp snaps over the edge of the reinforcement member to secure the bracket to the reinforcement member.

The bracket is secured without any additional fasteners between the reinforcement member and the bracket.

BRIEF DESCRIPTION OF THE SEVERAL VIEWS OF THE DRAWINGS

Other advantages of the present invention will be readily appreciated as the same becomes better understood by reference to the following detailed description when considered in connection with the accompanying drawings wherein.

DETAILED DESCRIPTION OF THE INVENTION

Referring to the Figures, wherein like numerals indicate like parts throughout the several views, an automotive heat exchanger assembly, e.g., a condenser, radiator, or the like, is generally shown at 10. The heat exchanger assembly 10 comprises of a core 12 having a length (l) extending between a first end and a second end and a width (w) extending between sides and a thickness (t) extending between faces. The core 12 is the well-known type made of regularly spaced tubes and intermediate corrugated air fins attached on the tubes for effective heat transfer. The tubes convey a fluid between the header tanks 14, 15.

Figure 1:
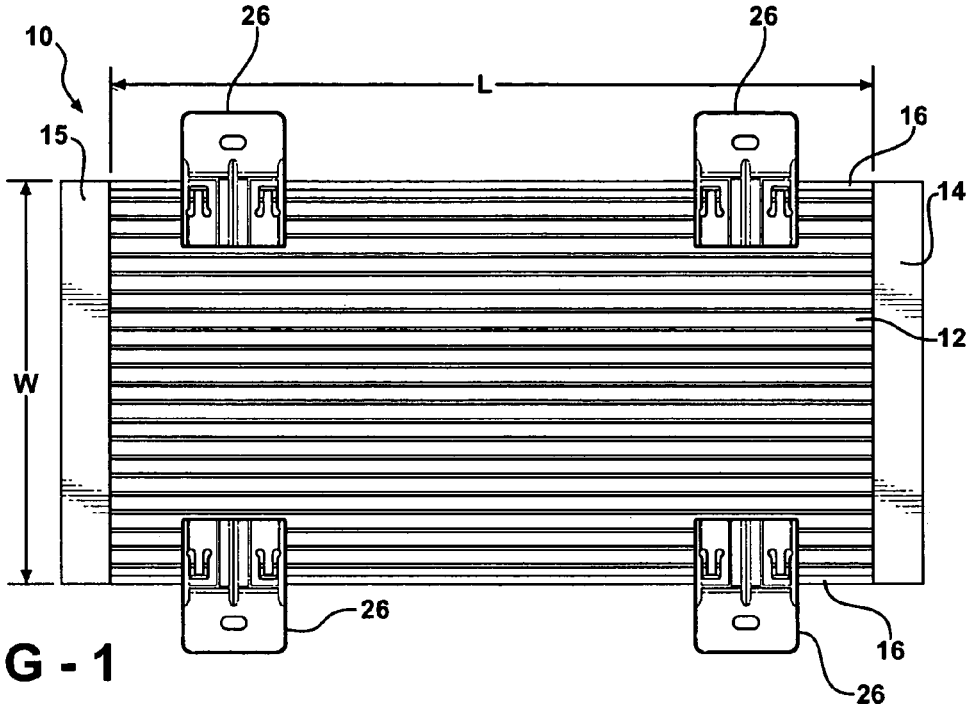
FIG. 1 is a frontal view of the heat exchanger assembly.
Figure 3:
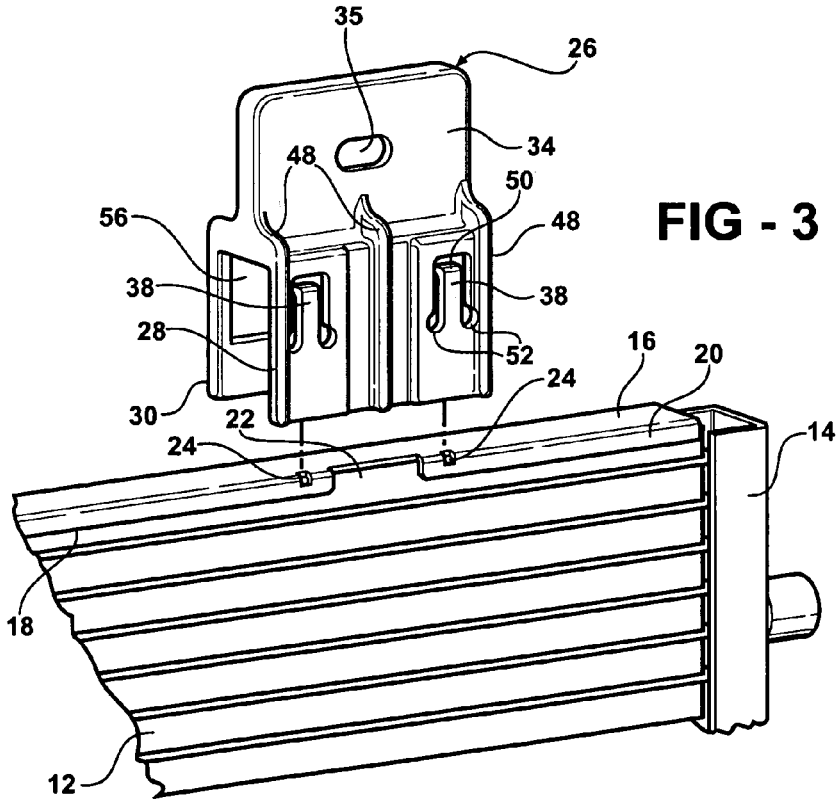
FIG. 3 is an exploded view of the bracket aligned to be attached to the heat exchanger assembly.

The heat exchanger assembly 10 generally shown in FIG. 1, includes a reinforcement member 16 extending along each side between the header tanks 14, 15 at the first and second ends of the core 12. Each reinforcement member 16 presents an edge 18 extending between the first and second ends. As shown in FIG. 3 the reinforcement member 16 is L-shaped having a long leg engaging the side of the core 12 and a shorter lip 20 perpendicular to the long leg to curl around and engage the face of the core 12. The reinforcement member 16 is a stamped component in the preferred embodiment, but could be of a different shape and created by other forming processes, such as extrusion and/or machining. The reinforcement member 16 has at least one notch 22 in the lip 20 and at least one hole 24 in the long leg portion. As will become clear below, the notch 22 and hole 24 are to secure the bracket to the heat exchanger 10. The reinforcement member 16 is secured to the core 12 during the furnace brazing operation of the core 12.

Figure 4:
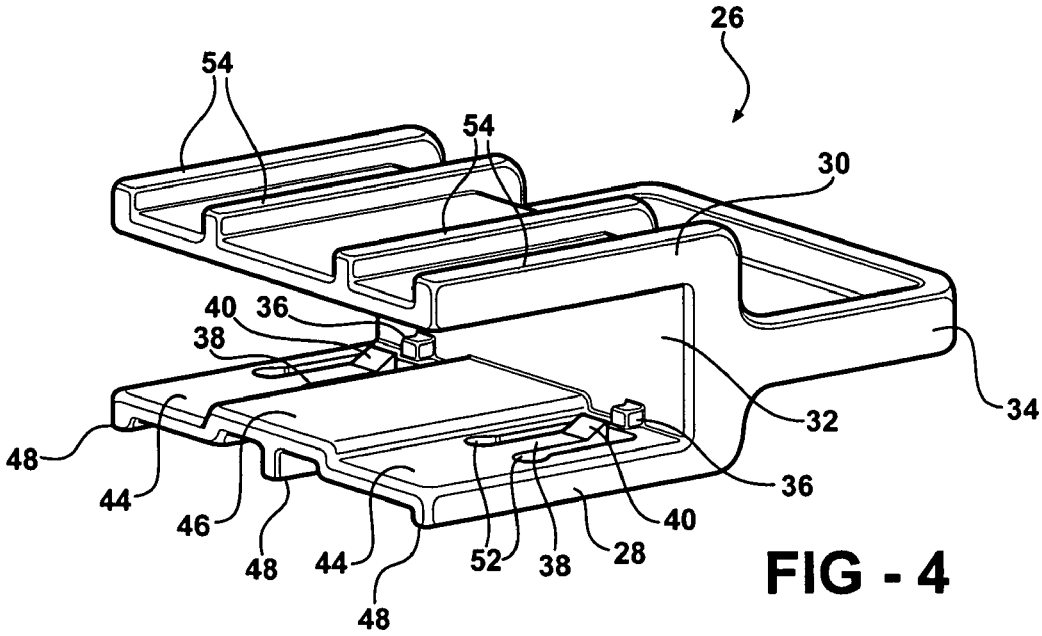
FIG. 4 is a side perspective view of the bracket.

The heat exchanger assembly 10 further includes at least one bracket 26 as shown in FIG. 4. The bracket 26 is preferably made of a plastic material. Each bracket 26 includes a pair of spaced and generally parallel arms 28, 30 for engaging a heat exchanger 10. A bottom wall 32 extends between the pair of arms 28, 30 and a support flange 34 extends away from the bottom wall 32 in the opposite direction from the arms 28, 30. The support flange 34 includes a hole 35 to allow the bracket 26 to be secured to a structure in the vehicle. However, one skilled in the art would appreciate that the support flange 34 can be adapted with other features such as a pin or bayonet for inserting into a mating feature on the vehicle or mating with other components or insulators. Extending from the bottom wall 32 is at least one male post 36 that extends into the hole 24 of the reinforcement member 16 when assembled to retain the bracket 26 in a lateral or cross-car direction.

The first arm 28 includes a resilient finger 38 and a protrusion 40 extending inward toward the second arm 30. The resilient finger 38 is disposed to extend from a root or connection at the first arm 28 and is supported in a cantilever fashion extending toward the bottom wall 32 to a distal end.

Figure 5:
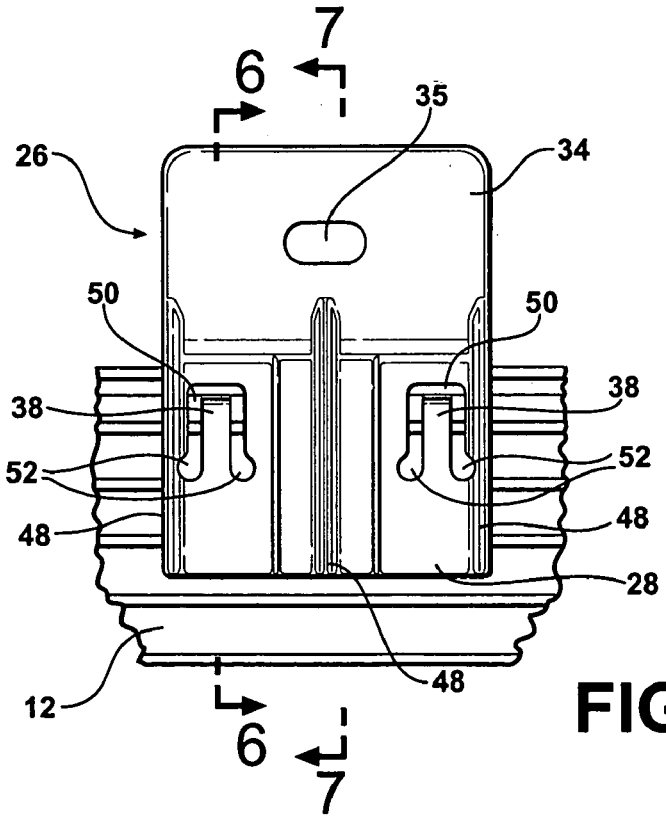
FIG. 5 is a front view of the bracket secured to the heat exchanger assembly.

The protrusion 40 presents a ramp or inclined surface on the distal end of the finger 38, which allows the resilient finger 38 to flex outward for snapping over and engaging with the reinforcement member 16 of the heat exchanger 10. As shown in FIG. 5, the ramp, of the protrusion 40, snaps over and engages the edge 18 of the reinforcement member 16 to secure the bracket 26 to the reinforcement member 16 and to prevent removal of the bracket 26 from the reinforcement member 16.

Figure 6:
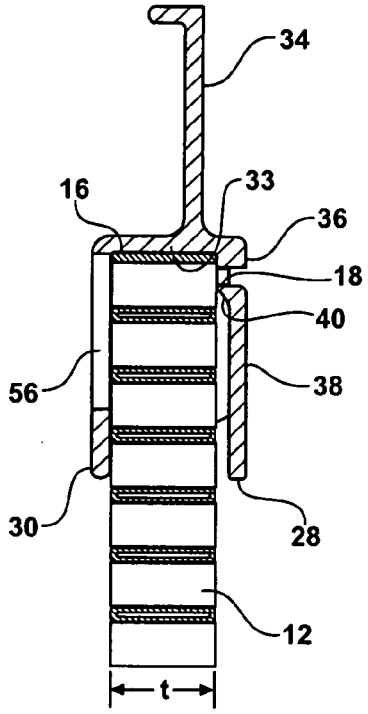
FIG. 6 is a cross-sectional view taken along line 6—6 of FIG. 5.
Figure 7:
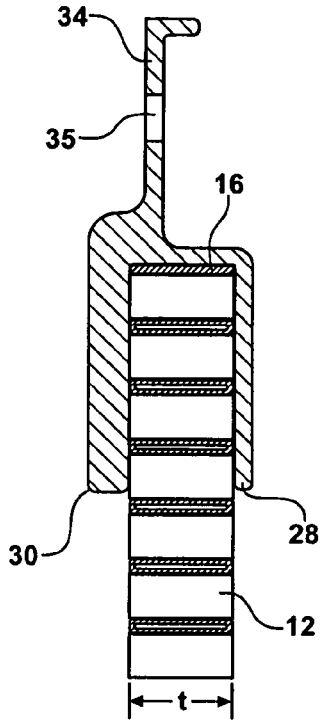
FIG. 7 is a cross-sectional view taken along line 7—7 of FIG. 5.

The first arm 28 of the bracket 26 includes a first section 44 supporting the finger 38 in spaced relationship to the adjacent face of the core 12 thereby allowing clearance, as shown in FIG. 6. A second section 46 of the first arm 28 engages the adjacent face of the core 12, as shown in FIG. 7. Referring to FIGS. 3–5, the first arm 28 includes a plurality of spaced and outwardly extending ribs 48 disposed in parallel relationship to the finger 38. The ribs 48 add rigidity to the first arm 28 allowing at least one opening between a pair of the ribs 48 disposed around the finger 38. The opening is a U-shaped opening 50 defining the finger 38. The U-shaped opening 50 includes round tear-drop openings 52 on each side of the root of the finger 38. The curved tear-drop openings 52 aid in the molding and manufacturing of the bracket, and reduce internal stresses around the root of the finger 38.

Figure 2:
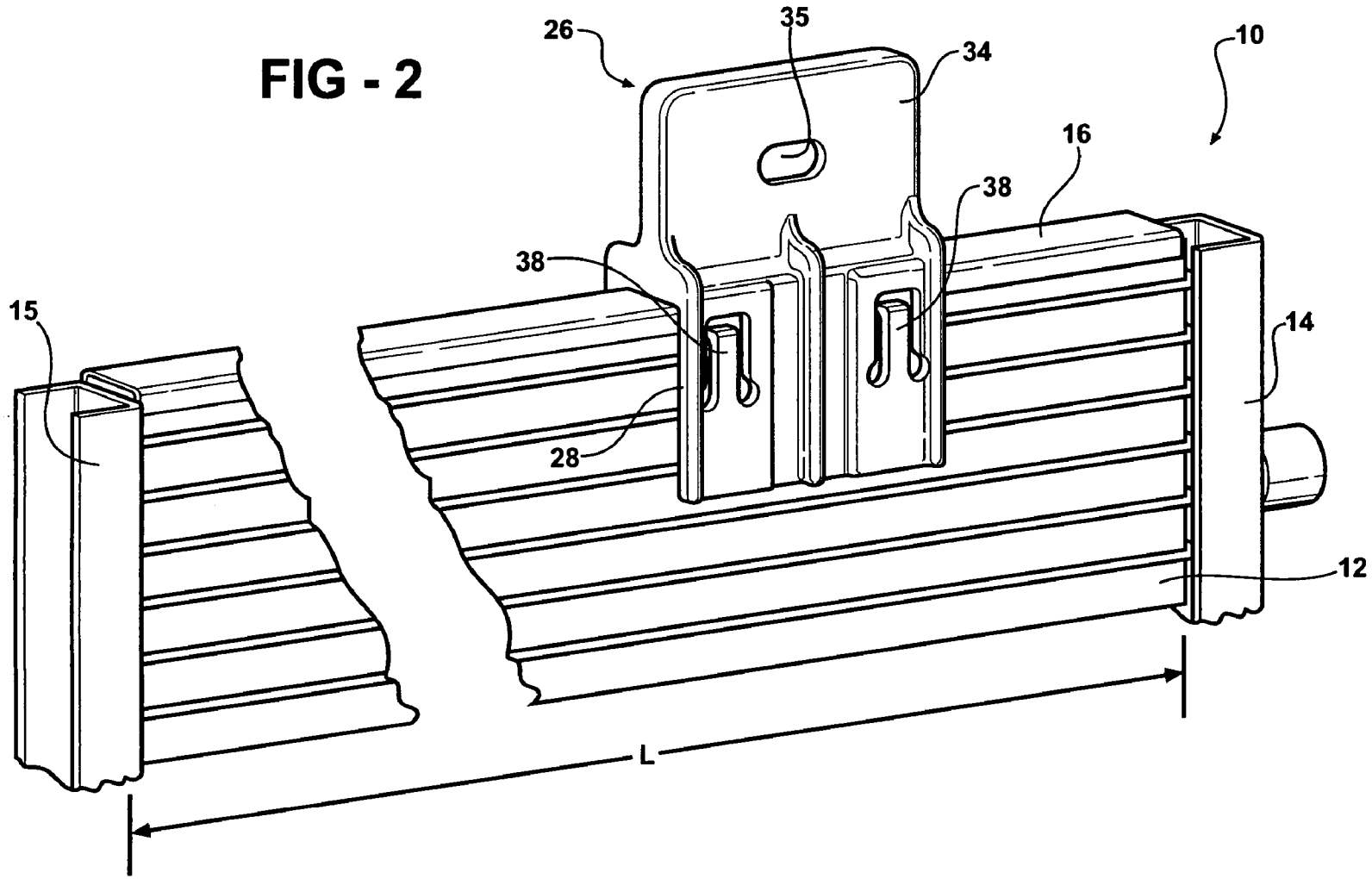
FIG. 2 is a perspective view of the heat exchanger assembly.
Figure 8:
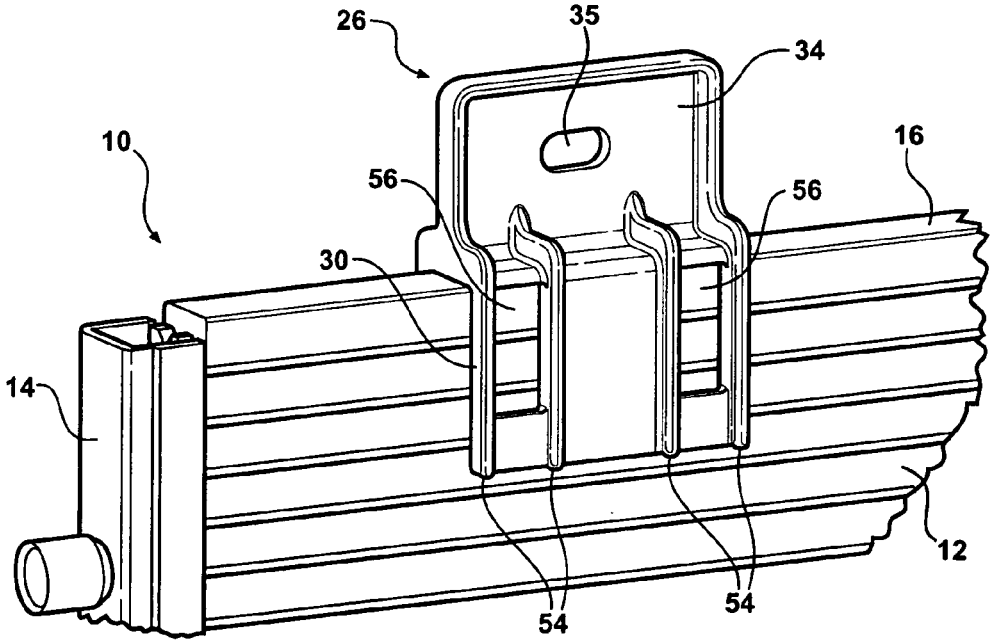
FIG. 8 is a back perspective view of the bracket secured to the heat exchanger assembly.

As shown in FIG. 8, the second arm 30 includes a plurality of spaced and outwardly extending ribs 54 disposed in a parallel relationship to the finger 38. The second arm 30 presents an opening 56 between two ribs 54 to expose additional surface area of the core 12, thereby increasing the heat transfer efficiency of the heat exchanger 10. The opening 56 is aligned on the opposite face of the core 12 across from the resilient finger 38, so that the openings 50, 56 on the first and second arms 28, 30 are aligned on the opposing faces of the core 12. As shown in FIGS. 2 and 5, the U-shaped opening 50 in the first arm 28 and the opening 56 in the second arm 30 create a path for airflow through the bracket 26 reducing the lost surface area due to the bracket 26 having an engagement over and on the faces of the core 12. Also, placing opening 56 opposite to the U-shaped opening 50 and male post 36 may make for simpler mold and tool design.

The bracket 26 including the resilient finger 38 and the protrusion 40 defining the ramp, allows the bracket 26 to be secured to the reinforcement member 16 after the brazing process with no additional fasteners between the bracket 26 and the core 12 or reinforcement member 16. The exploded view of FIG. 3 displays the alignment of the bracket 26 for attachment to the heat exchanger assembly 10. The bracket 26 is aligned such that the second section 46 of the first arm 28 can slidably pass through the notch 22 on the lip 20 of the reinforcement member 16 to engage the face of the core 12, as shown in FIG. 7. The male posts 36 extend from the bottom wall 32 and are aligned to engage the holes 24 in the reinforcement member 16, as shown in FIG. 6. As the bracket 26 is pushed toward the core 12 the resilient finger 38 flexes outward from the arms 28, 30 via the ramp, until the ramp snaps over the reinforcement member 16 to engage the edge 18, thereby securing the bracket 26 to the heat exchanger assembly 10 without the use of any additional fasteners.

The foregoing invention has been described in accordance with the relevant legal standards, thus the description is exemplary rather than limiting in nature. Variations and modifications to the disclosed embodiment may become apparent to those skilled in the art and do come within the scope of the invention. Accordingly, the scope of legal protection afforded this invention can only be determined by studying the following claims.

What is claimed is:

1. A heat exchanger assembly comprising;

a core having a first end and a second end defining a length (l) and sides defining a width (w) and opposite faces defining a thickness (t), at least one reinforcement member extending along a side thereof between said first end and said second end and having an edge, at least one bracket having a pair of spaced first and second arms extending around said reinforcement member and engaging said faces of said core for supporting said heat exchanger assembly, said first arm having a resilient finger and a protrusion extending inward toward said second arm, said resilient finger extending from a root at said first arm in a cantilever fashion toward said bottom wall to a distal end, said protrusion presenting a ramp to allow said finger to move over said reinforcement member as said resilient finger flexes outward from said arms until said ramp snaps over said edge of said reinforcement member to secure said bracket to said reinforcement member.

2. An assembly as set forth in claim 1 wherein said bracket further comprises a bottom wall extending between said pair of arms.

3. An assembly as set forth in claim 2 wherein said bracket includes a support flange extending from said bottom wall away from said arms.

4. An assembly as set for in claim 1 wherein said ramp is disposed on said distal end of said finger.

5. An assembly as set forth in claim 4 wherein said first arm includes a U-shaped opening defining said finger.

6. An assembly as set forth in claim 5 wherein said U-shaped opening includes round tear-drop opening on each side of said root of said finger.

7. An assembly as set forth in claim 5 wherein said second arm includes at least one rib projecting outward from said first arm.

8. An assembly as set forth in claim 7 wherein said second arm includes two of said ribs and an opening between said ribs to expose said core.

9. An assembly as set forth in claim 5 wherein said first arm includes said resilient finger and said second arm includes an opening on the opposite face of said core from said resilient finger.

10. An assembly as set forth in claim 5 wherein said first arm includes a first section supporting said resilient finger and a second section for engaging the adjacent face of said core.

11. An assembly as set forth in claim 10 wherein said first section of said first arm supports said finger in spaced relationship to said adjacent face of said core thereby allowing clearance.

12. An assembly as set forth in claim 11 wherein said second arm includes a plurality of spaced and outwardly extending ribs disposed in parallel relation to said finger.

13. An assembly as set forth in claim 12 wherein said second arm includes at least one opening between a pair of said ribs and disposed opposite to said finger.

14. An assembly as set forth in claim 12 wherein said first arm includes a plurality of spaced and outwardly extending ribs disposed in parallel relationship to said finger.

15. An assembly as set forth in claim 14 wherein said opening is disposed between a pair of said ribs.

16. An assembly as set forth in claim 15 wherein said reinforcement member defines at least one hole and said bottom wall of said bracket includes at least one male post extending into said hole of said reinforcement member.

17. An assembly as set forth in claim 10 wherein said reinforcement member includes a lip curling around and engaging said face of said core and at least one notch to allow said second section of said first arm to slidably pass through said notch to engage with said face of said core.

18. An assembly as set forth in claim 1 wherein said bracket is made of a plastic material.

19. A bracket for mounting a heat exchanger comprising a core having sides defining a width (w) and opposite faces defining a thickness (t), said bracket comprising;

means comprising a pair of spaced first and second arms for extending around one side and engaging the faces of the heat exchanger, a bottom wall extending between said pair of arms, a support flange extending from said bottom wall in a direction opposite from said arms, said first arm including a resilient finger comprising protrusion means extending inward toward said second arm, said protrusion means presenting a ramp to allow said resilient finger to flex outward for snapping over the side and engaging the faces of the heat exchanger, said resilient finger extending from a root at said first arm in a cantilever fashion toward said bottom wall to a distal end, said ramp being disposed on said distal end of said finger.

20. A bracket as set forth in claim 19 wherein said first arm includes a U-shaped opening defining said finger.

21. A bracket as set forth in claim 20 wherein said U-shaped opening includes round tear-drop opening on each side of said root of said finger.

22. A bracket as set forth in claim 20 wherein said second arm includes at least one rib projecting outward from said first arm.

23. A bracket as set forth in claim 22 wherein said second arm includes two of said ribs and an opening between said ribs to expose said core.

24. A bracket as set forth in claim 20 wherein said first arm includes said resilient finger and said second arm includes an opening on the opposite face of said core from said resilient finger.

* * * * *